US005370461A

United States Patent [19]

Smith et al.

[11] Patent Number: 5,370,461

[45] Date of Patent: Dec. 6, 1994

[54] CARRYING BAG CONVERTIBLE INTO AN ENVELOPE

[75] Inventors: Scott L. Smith; John A. Blake, both of Danbury, Conn.

[73] Assignee: United Parcel Service of America, Inc., Atlanta, Ga.

[21] Appl. No.: 120,674

[22] Filed: Sep. 13, 1993

[51] Int. Cl.[5] ..... B65D 33/06

[52] U.S. Cl. ..... 383/4; 383/14; 383/31; 229/68 C

[58] Field of Search ..... 383/4, 14, 30, 31, 28; 229/68 C, 300

[56] References Cited

U.S. PATENT DOCUMENTS

| | | | |
|---|---|---|---|
| 1,484,553 | 2/1924 | Crawford | 229/68 C |
| 1,537,956 | 5/1925 | McNally . | |
| 1,642,116 | 9/1927 | Krueger | 229/68 C |
| 1,685,885 | 10/1928 | Snyder | 229/68 C |
| 2,563,340 | 8/1951 | Kelly | 229/300 X |
| 2,985,355 | 5/1961 | Read | 383/14 X |
| 4,750,609 | 6/1988 | Felis | 229/68 C X |
| 4,790,670 | 12/1988 | Barbaro | 383/14 X |
| 5,092,515 | 3/1992 | Murray | 229/302 |

*Primary Examiner*—Allan N. Shoap
*Assistant Examiner*—Jes F. Pascua
*Attorney, Agent, or Firm*—Jones & Askew

[57] ABSTRACT

A convertible carrying bag/envelope suitable for carrying and shipping printed materials and other items. The bag/envelope provides a handle that may be used to carry the bag/envelope while allowing items to be placed into or removed from the interior of the bag. The bag/envelope provides an exterior flap that is operative for sealing the bag, on which delivery indicia is printed, so that it may be shipped via a small package delivery service. To prepare the bag for shipping, the handle is folded into the interior of the bag. The flap is then extended across the opening and affixed to the opposite panel using the pressure-sensitive adhesive provided on the flap.

19 Claims, 2 Drawing Sheets

CARRYING BAG CONVERTIBLE INTO AN ENVELOPE

TECHNICAL FIELD

The present invention relates generally to small package delivery envelopes, and more particularly relates to carrying bags that can be converted into small package delivery envelopes.

BACKGROUND OF THE INVENTION

Each year, millions of people attend trade shows and conventions of various types. Most trade shows and conventions include space where a variety of vendors display and promote their products and/or services. In addition to displaying their products and/or services, vendors often distribute advertising brochures and other literature, as well as free promotional items such as pens, pencils, stickers, badges, screwdrivers, candy, posters, etc. Each registrant may also receive a large package of materials such as a program and abstracts of the proceedings.

If a trade show attendee collects more than a few pieces of information, he or she may suffer some difficulty or inconvenience carrying it around the trade show unless the attendee has brought a brief case or bag of some sort. In order to facilitate an attendee's collection and transportation of trade show information, many vendors provide carrying bags of various types, which may be used to carry the brochures and other items collected during the trade show or convention. In most cases, the bags provided by the vendors are plastic and are printed with the vendor's name, logo, or other identifying information.

It is not uncommon, particularly at large trade shows, for an attendee to gather one or more bags of information from various vendors. When this occurs, the information can become fairly bulky and heavy, and may be somewhat difficult to carry back to the attendee's home or office. This is particularly true where the attendee has traveled by air from another city to attend the trade show, or where the attendee may be continuing his or her travel to other destinations before returning to the office.

Until now, a trade show attendee who wanted to get a fairly bulky package back to his or her home or office had two primary alternatives: the attendee could carry the heavy, bulky materials in other luggage or as separate packages, or the attendee could seek out packaging materials and shipping services suitable for shipping the package back to the home or office.

Therefore, there is a need in the art for a convertible carrying bag/envelope that may be used to carry information obtained at a trade show or convention, and which may be conveniently converted into a sturdy shipping envelope suitable for shipping the information back to the attendee's home or office.

SUMMARY OF THE INVENTION

The present :invention satisfies the above described needs by providing a container that is convertible from a carrying bag into an envelope. The convertible carrying bag/envelope includes a handle that allows the bag and its contents to be carried easily, while also allowing items to be placed into or removed from the interior of the bag. In addition, the bag/envelope provides an exterior flap that may be used to seal the bag in a manner suitable for shipment via a small package delivery service.

Generally described, the present invention provides a convertible carrying bag/envelope that includes a bag and a handle. The bag includes first and second panels that together extend to an opening at one end of the bag. The handle is located adjacent the opening and is attached to one of the panels. The handle is attached so that it is capable of being positioned in the interior of the bag. The convertible carrying bag/envelope also includes a flap attached to the first panel and adjacent the opening, and an area of adhesive applied to the flap or the second panel. The adhesive is positioned to secure the flap to the second panel so as to close the opening. The convertible carrying bag/envelope also includes delivery indicia located on one of the panels.

In its closed configuration, the handle is positioned in the interior of the bag. The flap is affixed to the second panel so as to close the opening and thereby seal the envelope.

The present invention also provides a method for converting a carrying bag into a delivery envelope. The method includes the step of providing a carrying bag that includes first and second panels extending to an opening, a handle located adjacent the opening and attached to one of the panels, and a flap attached to the first panel. The method also includes the steps of folding the handle into the interior of the bag, closing the opening with the flap, affixing the flap to the second panel and providing delivery indicia.

Accordingly, it is an object of the present invention to provide a carrying bag that is easily convertible into a shipping envelope.

It is another object of the present invention to provide a convertible carrying bag/envelope that is suitable for hand carrying printed materials or other items and for shipping the items via a small package delivery service.

It is another object of the present invention to provide a convertible carrying bag/envelope that may be sealed in a manner suitable for shipment via a small package delivery service.

These and other objects, features, and advantages of the present invention may be more clearly understood and appreciated from a review of the following detailed description of the preferred embodiments and by reference to the appended drawings and claims.

DETAILED DESCRIPTION OF THE PREFERRED EMBODIMENT

Figure 1:
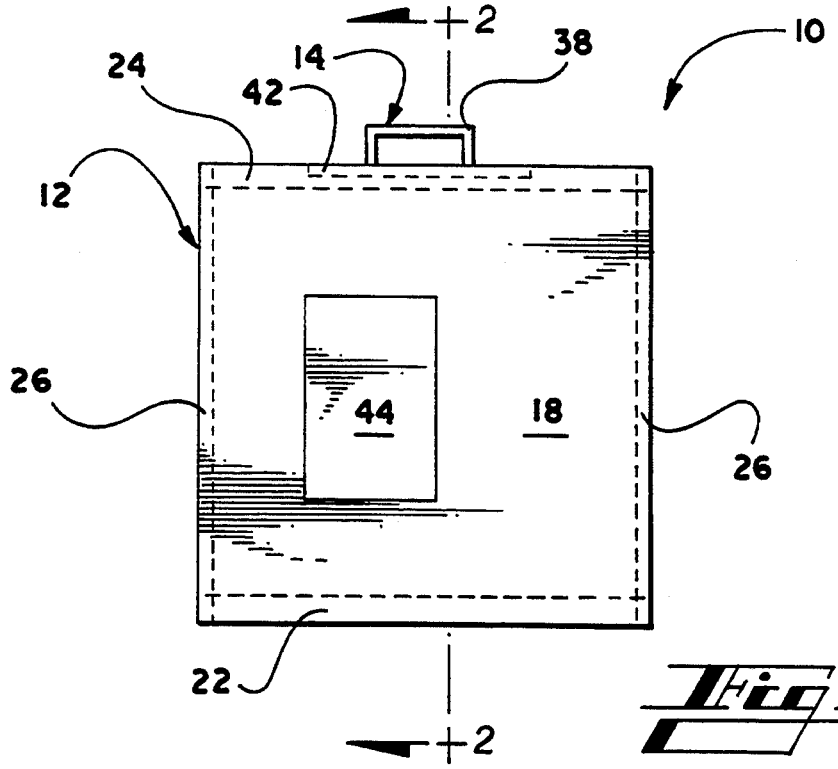
FIG. 1 is a front view of a convertible carrying bag/envelope constructed in accordance with the present invention.
Figure 2:
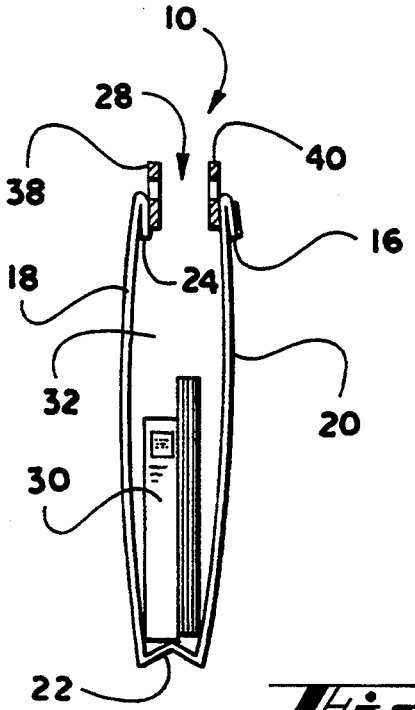
FIG. 2 is a cross sectional view of the convertible carrying bag/envelope taken along the line 2—2 of FIG. 1 and illustrating the bag in the open position with contents inside.

Referring now to the drawings, in which like numerals represent like elements throughout the several figures, FIGS. 1 and 2 illustrate a convertible carrying bag/envelope 10 constructed in accordance with a preferred embodiment of the present invention. The preferred convertible carrying bag/envelope 10 is designed to provide a sturdy bag 12 and handle 14 that may be used to carry items such as printed material obtained at trade shows. The convertible carrying bag/envelope 10 also includes a sealing flap 16 that is used to seal the bag, and thereby convert the carrying bag into a shipping envelope suitable for shipping the contents of the bag to one's office or home via a small package delivery service. Thus, the carrying bag/envelope 10 provides a container that is suitable for carrying and shipping various items.

The convertible carrying bag/envelope 10 includes a bag 12, handle 14, and sealing flap 16. The bag 12 is formed from a single sheet of plastics material. The sheet of plastic is folded and creased in the manner illustrated in the accompanying figures to provide front and rear panels 18 and 20, sealing flap 16, expandable bottom gusset 22, and an inner flap 24. After the plastic sheet is folded and creased, the panels are welded together along welded edges 26. An opening 28 is provided along the top edges of the front and rear panels 18, 20. The opening 28 is used to deposit contents 30, such as printed materials and other items, into the interior 32 of the convertible carrying bag/envelope 10.

In the preferred convertible carrying bag/envelope 10, the bag 12 is made of an extruded three-ply polyethylene material. A suitable material is described in U.S. Pat. No. 4,082,880 to Zboril, entitled "Paper-like Thermoplastic Film". The bag 12 is formed from a sheet of material that measures approximately 18.5 by 41.5 inches. The sheet is folded so that the front and rear panels 18, 20 measure 18.5 inches wide by 18 inches deep. The sealing flap 16 and inner flap 24 extend approximately 2 and 0.5 inches, respectively, from the opening 28. The bottom gusset 22 will expand to a width of approximately 3 inches. The outer layer of the bag is corona treated to ensure better printing and adhesion. The exterior of the bag/envelope 10 is printed using a flexographic printing process.

After the sheet is folded with a tuck in the bottom to form the gusset 22, and with the inner flap 24 folded between the front and rear panels 18, 20, the panels are joined together along welded edges 26. The panels are joined together using a 0.25 inch broad side seal that is formed by welding the panels together with heat and pressure. In order to restrain the sealing flap 16 until it is used, the flap 16 is tacked to the rear panel 20 using an impulse heat seal. This seal is formed along the outer edge of the flap 16 and is approximately 1/32 inch wide. Although such a seal is easily detachable, it satisfactorily retains the sealing flap 16 against the rear panel 20 until the flap is ready for use.

Figure 3:
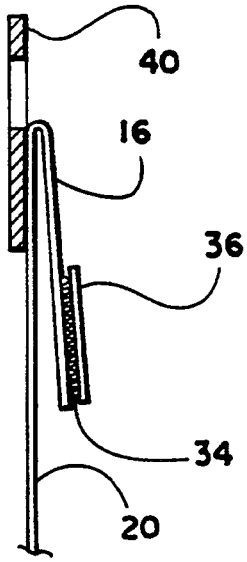
FIG. 3 is a magnified view of the flap that forms a part of the convertible carrying bag/envelope illustrated in FIG. 2.

The purpose of the sealing flap 16 is to securely seal the opening 28 and prepare the bag for shipment. As described above, the flap 16 extends along the entire width of the opening 28. As more clearly illustrated in FIG. 3, the flap 16 includes a band of pressure-sensitive adhesive 34. The preferred adhesive 34 is a conventional, self-sealing, pressure sensitive hot melt adhesive of the type commonly used for sealing plastic delivery envelopes. The adhesive is applied to the flap in six parallel beads, each of which is 1/16 inches wide and extends the width of the flap. Until the flap is used to seal the bag, the adhesive 34 is covered by a removable protective covering, such as a strip of release paper 36. The preferred release paper 36 is a silicone treated release liner of the type conventionally used on delivery envelopes. The preferred method for using the flap 16 to seal the opening 28 is described below in conjunction with FIGS. 5 and 6.

The handle 14 is positioned adjacent opening 28. Although a single-piece handle may be sufficient, the preferred handle includes front and rear handle members 38, 40 that are attached to the inner flap 24 and rear panel 20, respectively. The front and rear handle members 38, 40 are similarly shaped. Each includes an elongate plastic strip 42 that is attached to the interior of the respective panel along its top edge. The plastic strips 42 are approximately 10 inches long and are centered in the opening 28, so as to provide sufficient rigidity to maintain the shape of the bag. Loops for grasping with the fingers are integrally molded with the strips 42. Furthermore, the handle members 38, 40 may be provided with mating snap connectors (not shown) to allow them to be joined in a conventional manner to close the bag. The front and rear handle members 38, 40 are molded from high density and low density polyethylene, and are attached to the inner flap 24 and rear panel 20 by heat sealing.

Figure 4:
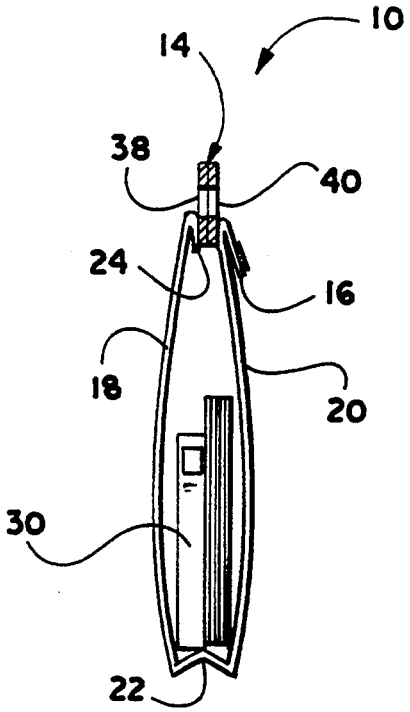
FIG. 4 is a cross sectional view of the convertible carrying bag/envelope illustrating the position of the handles when used to carry the bag.

FIG. 4 is a cross sectional view of the convertible carrying bag/envelope 10 illustrating the position of the handles when used to carry the bag. In most cases, the present inventor anticipates that the convertible carrying bag/envelope 10 will be carried with the front and rear handle members 38, 40 of handle 14 held together in the manner illustrated in FIG. 4. When the handle 14 is held in this manner, the bag/envelope 10 and its contents 3t}may be carried conveniently in one hand. Those skilled in the art will appreciate that the preferred front and rear handle members 38, 40 are constructed with complementary pins and holes (not shown) so that they snap together in a manner known in the art. In this manner, the handle 14 is operative for forming a reusable, temporary closure for the bag.

The preferred construction provides an durable, inexpensive bag/envelope that is suitable for carrying relatively bulky, heavy loads, and for shipping the contents to a remote destination via a small package delivery service. The exterior of the preferred convertible carrying bag/envelope 10 is receptive to printing inks so that a delivery indicia as well as a company's name, logo, or other advertising information may be printed on the exterior of the bag. In addition, the preferred bag is impervious to moisture and is highly resistant to tears and abrasion. Those skilled in the art will be familiar with other materials from which the convertible carrying bag/envelope may be constructed.

Those skilled in the art also will appreciate that the bag 12 may be formed differently without departing from the disclosed advantages of the present invention. For example, an expandable bag suitable for carrying larger objects may be provided by employing expandable gussets along the sides of the bag. These gussets may :includes one or more folds that expand and contract in a bellows-like or accordion-like manner. When the bellows-like panels are fully expanded, the bag may take on more of a box-like shape and may have a cross-section similar to the shape of a rectangle.

Figure 5:
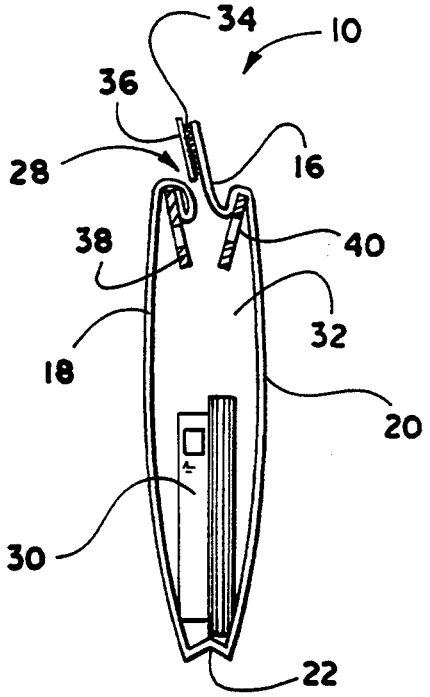
FIG. 5 is a cross sectional view of the convertible carrying bag/envelope illustrating the handles folded into the interior of the bag.
Figure 6:
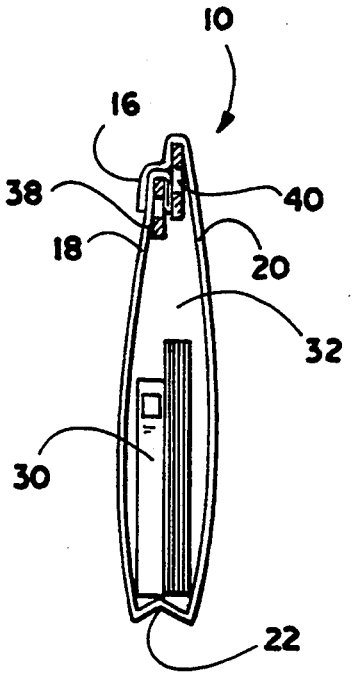
FIG. 6 is a cross sectional view of the convertible carrying bag/envelope illustrating the flap affixed to the front panel so as to seal the opening of the bag.

Turning now to FIGS. 5 and 6, a method of sealing the preferred convertible carrying bag/envelope 10 for shipment via a small package delivery service will be described. After the contents 30 are placed in the :interior 32 of the bag, the front and rear handle members 38, 40 are folded into the opening 28 formed by the front and rear panels 18, 20. As illustrated in FIG. 4, the front and rear handle members 38, 40 extend into the interior 32 of the bag. At this point, the flap 16 remains on the exterior of the bag.

After the handle is positioned inside the bag, the convertible carrying bag/envelope 10 may be sealed by removing the release paper 36 from the adhesive 34 and by extending the flap 16 across the opening 28, so that the top exterior edges of the front and rear panels 18, 20 are pulled together. At this point, the flap 16 is affixed to the front panel 18 by pressing the exposed adhesive 34 against the front panel, as illustrated in FIG. 6. The adhesive 34, which is described above, is a pressure sensitive adhesive and is capable of securely sealing the carrying bag/envelope 10 by holding the top edges of the front and rear panels 18, 20 together.

Figure 7:
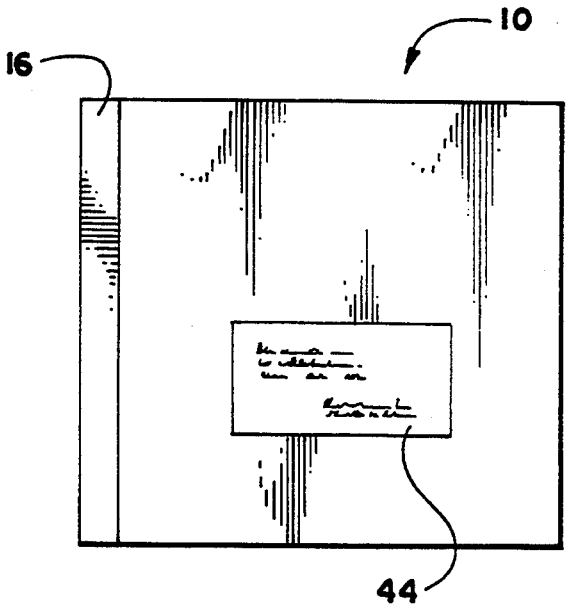
FIG. 7 is a front view of the convertible carrying bag/envelope illustrating the flap in the sealing position and the delivery indicia located on the front panel.

FIG. 7 is a front view of the convertible carrying bag/envelope 10 after it has been sealed in the manner described above. As also described above, the preferred flap 16 extends along the entire width of the opening formed by the front and rear panels and is affixed to the front panel 18 by the adhesive. In order to function as a shipping envelope, the convertible carrying bag/envelope 10 also includes delivery indicia 44. The preferred delivery indicia 44 defines an area suitable for affixing a shipping label or airbill. The shipping label is affixed to the front panel 18 and includes the address to which the package is to be delivered. Alternatively, the delivery indicia 44 may include an area in which the delivery address is written directly on the bag. A company sending many employees to various trade shows could provide bag/envelopes embodying the invention to its attendees and pre-print the address information on the bag.

Although the preferred flap extends along the entire width of the opening formed by the front and rear panels, those skilled in the art will appreciate that the flap 16 could be replaced by at least one smaller flap having a width less than that of the opening formed by the front and rear panels 18, 20, or multiple smaller flaps. However, the present inventor believes that the preferred flap 16, which covers the entire opening, provides the most effective means for sealing the envelope.

From the foregoing description, it will be understood that the convertible carrying bag/envelope of the present invention provides a bag that is suitable for carrying and shipping printed materials and other items. The bag/envelope provides a handle that may be used to carry the bag/envelope while allowing items to be placed into or removed from the interior of the bag. In addition, the bag/envelope provides an exterior flap that is operative for sealing the bag so that it may be shipped via a small package delivery service. In order to prepare the bag for shipping, the handle is folded into the interior of the bag. The flap is then extended across the opening and affixed to the opposite panel using the pressure-sensitive adhesive provided on the flap.

Once the contents have been deposited into the bag and the bag has been sealed in the manner described above, the convertible carrying bag/envelope is suitable for receipt and shipment by a small package delivery company. The present inventor contemplates that one or more small package delivery companies may find it advantageous to provide at trade shows and conventions a desk or booth where they accept such packages for shipment, and thereby provide a convenient way for trade show attendees to ship trade show materials to their home or office. At such a desk or booth, the delivery company may ensure that the addressee associated with the delivery indicia is properly indicated and may provide means for paying or charging the fee associated with shipment of the package.

The present invention has been described in relation to particular embodiments which are intended in all respects to be illustrative rather than restrictive. Alternative embodiments will become apparent to those skilled in the art to which the present invention pertains without departing from its spirit and scope. Accordingly, the scope of the present invention is defined by the appended claims rather than the foregoing description.

What is claimed is:

1. A convertible container, comprising:

a bag including first and second panels, said panels extending to an opening at one end of said bag;

a first handle located adjacent said opening and attached to said first panel, said handle being capable of being positioned in the interior of said bag;

a second handle located adjacent said opening and attached to said second panel, said handle being capable of being positioned in the interior of said bag;

a flap attached to said first panel and adjacent said opening;

an area of adhesive applied to one of said flap and said second panel and positioned to secure said flap to said second panel so as to close said opening; and delivery indicia located on one of said first panel and said second panel.

2. A convertible container as recited in claim 1, further comprising a removable covering operative for protecting said adhesive.

3. A convertible container as recited in claim 2, wherein said removable covering comprises a release liner.

4. A convertible container as recited in claim 1, wherein said delivery indicia comprises a label.

5. A convertible container as recited in claim 1, wherein said delivery indicia comprises indicia defining an area for receiving a label.

6. A convertible container as recited in claim 1, wherein said first and second handles are aligned with each other such that when said first and second handles are grasped together, said bag is held in a closed position.

7. A convertible; container as recited in claim 6, wherein said first and second handles comprise mating snap connectors for holding said first and second handles together.

8. A convertible container, comprising:

a bag including first and second panels, said panels extending to an opening at one end of said bag;

a first handle located adjacent said opening and attached to said first panel, said handle being positioned in the interior of said bag;

a second handle located adjacent said opening and attached to said second panel, said handle being positioned in the interior of said bag;

a flap attached to said first panel and adjacent said opening, said flap being affixed to said second panel by an adhesive so as to close said opening; and delivery indicia located on one of said first panel and said second panel.

9. A convertible container as recited in claim 8, wherein said adhesive is located on said second panel.

10. A convertible container as recited in claim 8, wherein said adhesive is located on said flap.

11. A convertible container as recited in claim 8, wherein said delivery indicia comprises a label.

12. A convertible container as recited in claim 8, wherein said delivery indicia comprises an area for receiving a label.

13. A convertible container, comprising:

a bag including first and second panels, said panels connected along side and bottom edges thereof and extending to an opening at one end of said bag;

a handle located adjacent said opening and attached to one of said first and second panels said handle defining an opening therethrough and extending outside said bag;

a flap attached to said first panel and adjacent said opening;

an area of adhesive applied to one of said flap and said second panel and positioned to secure said flap to said second panel so as to close said opening with said handle positioned entirely within the interior of said bag;

said handle being capable of being positioned in said interior of said bag prior to securing said flap; and delivery indicia located on one of said first panel and said second panel.

14. A method for converting a carrying bag into a delivery envelope, comprising the steps of:

providing a carrying bag including first and second panels extending to an opening, a first handle located adjacent said opening and attached to said first panel, a second handle located adjacent said opening and attached to said second panel, and a flap attached to said first panel;

folding said first handle into the interior of said bag;

folding said second handle into the interior of said bag;

closing said opening with said flap;

affixing said flap to said second panel; and providing delivery indicia.

15. A method for convening a carrying bag into a delivery envelope as recited in claim 14, wherein said adhesive is located on said flap.

16. A method for converting a carrying bag into a delivery envelope as recited in claim 14, wherein said adhesive is located on said second panel.

17. A method for converting a carrying bag into a delivery envelope as recited in claim 14, wherein said step of affixing said flap to said second panel comprises initially removing a removable covering operative for protecting said adhesive.

18. A method for converting a carrying bag into a delivery envelope as recited in claim 17, wherein said removable covering comprises release paper.

19. A method for converting a carrying bag into a delivery envelope as recited in claim 14, wherein said step of providing delivery indicia comprises affixing a label.

* * * * *